US005925151A

United States Patent [19]

DeCanio et al.

[11] Patent Number: 5,925,151

[45] Date of Patent: Jul. 20, 1999

[54] DETERGENT ADDITIVE COMPOSITIONS FOR DIESEL FUELS

[75] Inventors: Elaine C. DeCanio, Montgomery; Sheldon Herbstman, New City; Benjamin J. Kaufman, Hopewell Junction; Brian L. Papke, Wappingers Fall, all of N.Y.

[73] Assignee: Texaco Inc, White Plains, N.Y.

[21] Appl. No.: 08/715,076

[22] Filed: Sep. 19, 1996

[51] Int. Cl.[6] ..... C10L 1/18; C10L 1/22

[52] U.S. Cl. ..... 44/347; 44/331

[58] Field of Search ..... 44/347, 331

[56] References Cited

U.S. PATENT DOCUMENTS

| | | | |
|---|---|---|---|
| 3,658,494 | 4/1972 | Dorer, Jr. | 44/63 |
| 4,501,597 | 2/1985 | Karol et al. | 44/63 |
| 4,636,322 | 1/1987 | Nalesnik | 252/51.5 A |
| 4,895,578 | 1/1990 | Meyer et al. | 44/347 |
| 5,049,293 | 9/1991 | Blain et al. | 252/49.6 |
| 5,114,435 | 5/1992 | Abramo et al. | 44/348 |
| 5,160,649 | 11/1992 | Cardis et al. | 252/47.5 |
| 5,205,945 | 4/1993 | Cardis et al. | 252/47.5 |
| 5,256,165 | 10/1993 | Herbstman et al. | 44/347 |
| 5,264,004 | 11/1993 | Cardis et al. | 44/331 |
| 5,266,081 | 11/1993 | Avery et al. | 44/331 |
| 5,279,626 | 1/1994 | Cunningham et al. | 44/331 |
| 5,334,228 | 8/1994 | Ashjian et al. | 44/347 |
| 5,393,309 | 2/1995 | Cherpeck | 44/347 |
| 5,411,559 | 5/1995 | Malfer | 44/347 |
| 5,518,511 | 5/1996 | Russell et al. | 44/347 |
| 5,552,069 | 9/1996 | Avery et al. | 508/229 |
| 5,588,973 | 12/1996 | Blackborrow et al. | 44/347 |

FOREIGN PATENT DOCUMENTS

| | | | |
|---|---|---|---|
| 0 441 014 A1 | 8/1991 | European Pat. Off. | C10L 1/22 |
| 0 476 196 A1 | 3/1992 | European Pat. Off. | C10L 1/14 |
| WO 93/20170 | 10/1993 | WIPO | C10L 1/14 |
| WO 94/14929 | 7/1994 | WIPO | C10L 1/18 |
| WO 96/15209 | 5/1996 | WIPO | C10L 10/04 |

OTHER PUBLICATIONS

Papke et al., "Adsorption of Poly(isobutenyl)succinimide Dispersants onto Calcium Alkylarylsulfonate Colloidal Dispersions in Hydrocarbon Media,", *Langmuir*, vol. 7, No. 11, Nov. 1991, pp. 2614–2619.

Material Safety Data Sheet re Aromatic 100 Solvent, Jun. 3, 1992.

Material Safety Data Sheet re Aromatic 150, Solvesso 150, Feb. 9, 1988.

Material Safety Data Sheet re Aromatic 200 Solvent, May 12, 1992.

Material Safety Data Sheet re Shellsol AB, Apr. 1990.

Material Safety Data Sheet re HAN 857, May 17, 1991.

*Primary Examiner*—Jacqueline V. Howard

*Attorney, Agent, or Firm*—Henry H. Gibson; Arnold White & Durkee

[57] ABSTRACT

A detergent additive composition for diesel fuel contains a low molecular weight polyisobutylene monosuccinimide of polyethylene polyamine in an aromatic hydrocarbon diluent. The detergent additive composition may be used to remove or prevent engine deposits and their corrosive effects.

25 Claims, No Drawings

DETERGENT ADDITIVE COMPOSITIONS FOR DIESEL FUELS

FIELD OF THE INVENTION

The present invention is directed to fuel additive compositions and methods for their use in diesel fuels. More particularly, the invention is directed to detergent additive compositions containing a low molecular weight polyisobutylene monosuccinimide of polyethylene polyamine and an aromatic hydrocarbon diluent. The invention is further directed to methods that use such detergent additive compositions in diesel fuels for removing and preventing corrosion and deposits in the fuel and lubricant parts of the engine.

BACKGROUND OF THE INVENTION

Commercial diesel fuels contain impurities that can lead to deposition of solids and gums in engines during fuel combustion. Such engine deposit problems are of greater significance for diesel fuels than gasoline fuels because the diesel fuels generally contain greater concentrations of high molecular weight materials. The thermal breakdown of such materials forms insoluble deposits on the engine that can reduce operating efficiency and, ultimately, can lead to corrosion or blockage of fuel injectors and other critical working elements of an engine. Insoluble impurities may also be introduced from the external environment during processing, transport, or pumping of the fuel.

One desirable function of a fuel additive is to impart detergency properties upon the fuel mixture in order to prevent the unwanted deposition of solids during normal engine operation. Ideally, previously deposited materials may also be solubilized by an added detergent, potentially increasing engine performance. Materials imparting corrosion protection properties are additionally desirable in extending the lifetime of the engine.

Succinimide compounds have been used as detergents for fuel and lubricant formulations wherein the succinimide compounds are generally dissolved in a diluent fluid of oils or glycols. For example, U.S. Pat. No. 5,518,511 discloses the use of a gasoline detergent composition containing polyisobutylene succinimides and diluent oils such as mono end-capped polypropylene glycol, as well as other components such as anti-oxidants, dehazers, and deicers.

U.S. Pat. No. 5,334,228 discloses deposit control additives and fuel compositions containing polyalkenyl succinimides and diamondoid carrier fluids such as adamantane, diamantane, triamantane, and tetramantane. U.S. Pat. No. 5,114,435 discloses a composition containing a polyalkylene succinimide, a polyalkylene, and mineral oil for the removal and prevention of engine deposits for use in gasoline and diesel fuels. U.S. Pat. No. 5,264,004 discloses the reaction product of an aldehyde, a hydrocarbylsuccinimide dimer, and a heteroatom substituted benzoic acid as a multifunctional fuel and lubricant additive. The disuccinimide product is formulated with mineral oil, synthetic oil, or grease mixtures. U.S. Pat. No. 4,501,597 discloses the use of polyalkyleneamine succinimide oxamides as fuel detergents wherein at least 30% of amine moieties are derivitized with oxalic acid.

There is a need in the art for improved detergent additive compositions for diesel fuels that remove or prevent engine deposits and their corrosive effects.

SUMMARY OF THE INVENTION

The detergent additive compositions of the present invention contain a polyisobutylene monosuccinimide of the formula:

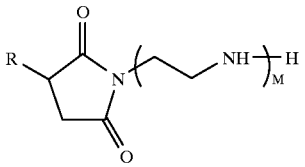

wherein R is a polyisobutylene group of number average molecular weight between 900 and 1100 and M is an integer from 1 to 5, and an aromatic hydrocarbon diluent. The inventive detergent additive composition is preferably used in a diesel fuel for removal and prevention of engine deposits and their corrosive effects.

DESCRIPTION OF ILLUSTRATIVE EMBODIMENTS

The polyisobutylene monosuccinimide compound used in the inventive detergent additive compositions is preferably a polyisobutylene monosuccinimide of a polyethylene polyamine having a low number average molecular weight, preferably in the range of about 900 to 1100, and most preferably about 1000. The polyethylene polyamine is preferably selected from the group consisting of ethylenediamine, diethylenetriamine, triethylenetetramine, tetraethylenepentamine, and pentaethylenehexamine, and more preferably triethylenetetramine. The polyisobutylene monosuccinimide of polyethylene polyamines may be prepared by conventional methods from immediate precursors commercially available from Amoco Chemical Company and Aldrich Chemical Company.

The polyisobutylene monosuccinimide compound is preferably present in the detergent additive composition in an amount of about 50% to 80% by weight, and more preferably in an amount of about 70% by weight. When the detergent additive composition is added to a diesel fuel, the polyisobutylene monosuccinimide compound is preferably present in the diesel fuel composition in an amount of about 10 PTB to 300 PTB (pounds per thousand barrels of fuel), more preferably in an amount of about 20 PTB to 150 PTB, and most preferably in an amount of about 25 PTB to 100 PTB.

The detergent additive composition preferably contains a hydrocarbon diluent, which is preferably an aromatic hydrocarbon diluent. For example, the hydrocarbon diluent may be toluene extract, Shellsolv AB, xylene, Aromatic 150, Aromatic 100, Aromatic 200, and HAN 857, and more preferably Shellsolv AB. Shellsolv AB is commercially available from Shell Chemical Company. Toluene extract, xylene, Aromatic 150, Aromatic 100, Aromatic 200, and HAN 857 are commercially available from Exxon Chemical Company. The hydrocarbon diluent is preferably present in the detergent additive composition in an amount of about 20% to 50% by weight, and more preferably in an amount of about 30% by weight.

In a preferred embodiment, a diesel fuel composition according to the invention comprises a major portion of a middle distillate fuel oil boiling in the range of 340° F. to 620° F., and a minor portion of the diesel fuel detergent of the present invention. Diesel fuels containing less than 500 parts per million sulfur are generally regarded as low sulfur diesel fuel. The inventive detergent additive composition is preferably added to a diesel fuel in an amount sufficient to remove or prevent deposits on an engine when it is run with such a diesel fuel composition and to thereby prevent corrosive effects from such deposits. More preferably, the inventive detergent additive composition is added to a diesel fuel in an amount from 10 PTB to 300 PTB of active detergent in the diesel fuel. The inventive detergent additive composition can be used in both high and low sulfur diesel fuel.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

EXAMPLES

Example 1

Preparation of polyisobutylene monosuccinimide of triethylenetetramine composition in aromatic hydrocarbon diluent Poly(isobutenyl)succinic acid anhydride (1315.0 g, 1.00 moles, prepared from a polyisobutylene of approximately 1000 number average molecular weight (Indopol H-100 supplied by Amoco Chemical Company)) was charged into a 5 L three neck flask equipped with a mechanical stirrer, thermometer, and nitrogen inlet and reflux condenser. Aromatic hydrocarbon solvent Shellsolv AB (981.0 g) was added, a nitrogen flow started, and the mixture heated to 60° C. Triethylenetetramine (TETA, Aldrich Chemical, 131.62 g, 0.900 moles) was added and the temperature increased to 120° C. After 1.0 hours, the temperature was increased to 160° C. and maintained for an additional 2.0 hours. The warm mixture was filtered through a diatomaceous earth filter aid material. The product (approximately a 70% concentrate) was analyzed as follows: Percent Nitrogen=2.12%. Total Acid Number (TAN, ASTM D 974)=1.55. Total Base Number (TBN, ASTM D 2896)=50.

Example 2

Cummins N-14 corrosion protection test

The Cummins N-14 corrosion test was used to evaluate the corrosion protection properties of a triethylenetetramine monosuccinimide having a polyisobutylene group of number average molecular weight 1000 (H-100) and a triethylenetetramine monosuccinimide analog having a polyisobutylene group of number average molecular weight in the range of 1290 (H-300). The Cummins N-14 test measures change in the flow rate of a fluid through an injector orifice. Corrosion of the injector results in an increased flow rate. Addition of protective agents to the fluid may prevent or minimize the increase in flow rate through the orifice. Increases of less than 0.6% are rated acceptable, while increases of less than 0.03% are rated superior.

Mixtures of the H-300 polyisobutylene monosuccinimide of triethylenetetramine in Howell base fuel were made at 50, 100, and 150 PTB (pounds per thousand barrels of fuel), and a mixture of the H-100 polyisobutylene monosuccinimide of triethylenetetramine was made at 75 PTB. The four mixtures and a control liquid of Howell base fuel without corrosion protection additive were assayed by the Cummins N-14 corrosion test. The results are shown in Table 1.

TABLE 1

Cummins N-14 Corrosion Protection Test

| Fuel additive | Flow rate increase in volume percent |
|---|---|
| None (Howell base fuel) | 7.2% |
| 50 PTB H-300 polyisobutylene monosuccinimide of TETA | 3.3% |
| 100 PTB H-300 polyisobutylene monosuccinimide of TETA | 2.1% |
| 150 PTB H-300 polyisobutylene monosuccinimide of TETA | 2.1% |
| 75 PTB H-100 polyisobutylene monosuccinimide of TETA | 0.2% |

The results clearly show the efficacy of the H- 100 polyisobutylene monosuccinimide of triethylenetetramine in protecting the injector from corrosion. Fuels containing the H-300 polyisobutylene monosuccinimide of triethylenetetramine show greater corrosion protection relative to untreated fuel, yet show flow rate increases higher than the 0.6% necessary for an acceptable rating. Fuel containing the H-100 polyisobutylene monosuccinimide of triethylenetetramine at 75 PTB shows corrosion protection at the acceptable rating of below 0.6% increase in flow rate.

Example 3

Cummins L-10 detergency test

The Cummins L-10 detergency test was used to compare the detergency properties of the H-100 polyisobutylene monosuccinimide of triethylenetetramine and the H-300 polyisobutylene monosuccinimide of triethylenetetramine analog. The Cummins L-10 deposit measures injector cleanliness after passage of fuel. Deposits on the injector result in a decreased flow rate. Addition of agents with detergent properties to the fuel may prevent or minimize the deposition of materials on the injector. Flow rate decreases of less than 7% are rated acceptable, while decreases of less than 6% are rated superior. A CRC rating of less than 25 is rated acceptable, while a rating of less than 10 is rated superior.

Mixtures of the H-300 polyisobutylene monosuccinimide of triethylenetetramine in diesel fuel were made at 50, 100, and 150 PTB, and a mixture of the H-100 polyisobutylene monosuccinimide of triethylenetetramine was made at 75 PTB. The four mixtures and a control liquid of diesel fuel without detergent additive were assayed by the Cummins L-10 detergency assay. The results are shown in Table 2.

TABLE 2

Cummins L-10 Detergency Test Results

| Fuel additive | Basic nitrogen | Flow rate decrease in volume percent | CRC Rating |
|---|---|---|---|
| None (diesel fuel) | 0 | 5.4 | 25–27 |
| 50 PTB H-300 polyisobutylene monosuccinimide of TETA | 0.38 | 4.2 | 22.8 |
| 100 PTB H-300 polyisobutylene monosuccinimide of TETA | 0.76 | 4.3 | 13.1 |
| 150 PTB H-300 polyisobutylene monosuccinimide of TETA | 1.14 | 4.8 | 16.2 |
| 75 PTB H-100 polyisobutylene monosuccinimide of TETA | 0.75 | 1.0 | 9.4 |

These results demonstrate the superior detergency properties of the H-100 polyisobutylene monosuccinimide of triethylenetetramine as measured by both flow rate decrease and the CRC rating scale. Based upon the basic nitrogen content, diesel fuel containing 150 PTB H-300 polyisobutylene monosuccinimide of triethylenetetramine would be expected to have the best performance in an L-10 detergency assay, as basic nitrogen content is a general indicator of detergency properties. The superior performance of the H-100 polyisobutylene monosuccinimide of triethylenetetramine therefore runs counter to predictions based upon nitrogen content.

Example 4

MWM-B oil deposit test

The MWM-B oil deposit test determines deposit tendencies in the piston area of a single cylinder diesel engine operating at 2200 rpm for 50 hours. In our modification of the test, the base fuel and oil were kept constant and the amount and type of additive in the fuel was varied. Fuels containing additives are compared to a reference high sulfur diesel fuel (1.0% sulfur content). An additive's effect on ring sticking, wear, and accumulation of deposits is determined with a piston rating, where a higher value denotes better performance of the piston.

TABLE 3

MWM-B piston cleanliness test

| Fuel composition | Piston merit rating |
|---|---|
| Base fuel | 56 |
| Base fuel and H-300 polyisobutylene monosuccinimide of TETA | 46 |
| Base fuel and H-100 polyisobutylene monosuccinimide of TETA | 61.8 |

These results shows the beneficial effects of the H-100 polyisobutylene monosuccinimide of triethylenetetramine in this test as compared to either base fuel or base fuel with the H-300 polyisobutylene monosuccinimide of triethylenetetramine.

While the compositions and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the sprit, scope and concept of the invention.

What is claimed is:

1. A detergent additive composition for diesel fuel comprising a polyisobutylene monosuccinimide of the formula:

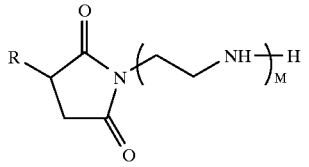

wherein R is a polyisobutylene group of number average molecular weight between 900 and 1100 and M is an integer from 1 to 5; and an aromatic hydrocarbon diluent.

2. The composition of claim 1, wherein the concentration of the polyisobutylene monosuccinimide in the additive composition is about 50% to 80% by weight.

3. The composition of claim 2, wherein the concentration of the polyisobutylene monosuccinimide in the additive composition is about 70% by weight.

4. The composition of claim 1, wherein M is 3.

5. The composition of claim 1, wherein the aromatic hydrocarbon diluent is an aromatic solvent selected from the group consisting of toluene extract, Shellsolv AB, xylene, Aromatic 150, Aromatic 100, Aromatic 200, and HAN 857.

6. The composition of claim 5, wherein the aromatic hydrocarbon diluent is Shellsolv AB.

7. The composition of claim 1, wherein the aromatic hydrocarbon diluent is Shellsolv AB and M is 3.

8. A diesel fuel composition comprising a diesel fuel and a detergent additive composition comprising a polyisobutylene monosuccinimide of the formula:

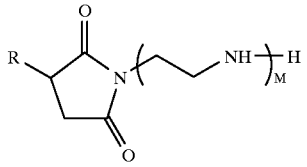

wherein R is a polyisobutylene group of number average molecular weight between 900 and 1100 and M is an integer from 1 to 5; and an aromatic hydrocarbon diluent.

9. The diesel fuel composition of claim 8, wherein the aromatic hydrocarbon diluent is an aromatic solvent selected from the group consisting of toluene extract, Shellsolv AB, xylene, Aromatic 150, Aromatic 100, Aromatic 200, and HAN 857.

10. The diesel fuel composition of claim 9, wherein the aromatic hydrocarbon diluent is Shellsolv AB.

11. The diesel fuel composition of claim 8, wherein M is 3.

12. A method of making a diesel fuel composition comprising blending a diesel fuel and a detergent additive composition comprising a polyisobutylene monosuccinimide of the formula:

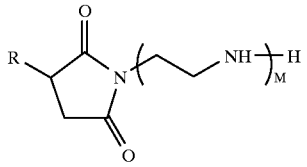

wherein R is a polyisobutylene group of number average molecular weight between 900 and 1100 and M is an integer from 1 to 5; and an aromatic hydrocarbon diluent.

13. The method of claim 12, wherein the aromatic hydrocarbon diluent is an aromatic solvent selected from the group consisting of toluene extract, Shellsolv AB, xylene, Aromatic 150, Aromatic 100, Aromatic 200, and HAN 857.

14. The method of claim 13, wherein the aromatic hydrocarbon diluent is Shellsolv AB.

15. The method of claim 12, wherein M is 3.

16. A method for removing engine deposits in a diesel engine comprising running the diesel engine with a fuel containing an effective amount of a detergent additive composition comprising a polyisobutylene monosuccinimide of the formula:

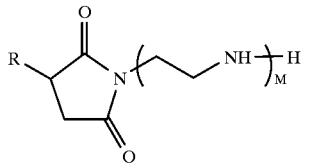

wherein R is a polyisobutylene group of number average molecular weight between 900 and 1100 and M is an integer from 1 to 5; and an aromatic hydrocarbon diluent.

17. The method of claim 16, wherein the aromatic hydrocarbon diluent is an aromatic solvent selected from the group consisting of toluene extract, Shellsolv AB, xylene, Aromatic 150, Aromatic 100, Aromatic 200, and HAN 857.

18. The method of claim 17, wherein the aromatic hydrocarbon diluent is Shellsolv AB.

19. The method of claim 16, wherein M is 3.

20. The method of claim 16, wherein the effective amount of detergent additive is about 10 PTB to 300 PTB.

21. A method for preventing engine deposits in a diesel engine comprising running the diesel engine with a fuel containing an effective amount of a detergent additive composition comprising a polyisobutylene monosuccinimide of the formula:

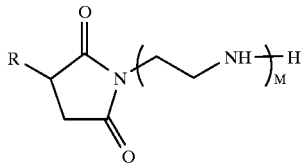

wherein R is a polyisobutylene group of number average molecular weight between 900 and 1100 and M is an integer from 1 to 5; and an aromatic hydrocarbon diluent.

22. The method of claim 21, wherein the aromatic hydrocarbon diluent is an aromatic solvent selected from the group consisting of toluene extract, Shellsolv AB, xylene, Aromatic 150, Aromatic 100, Aromatic 200, and HAN 857.

23. The method of claim 22, wherein the aromatic hydrocarbon diluent is Shellsolv AB.

24. The method of claim 21, wherein M is 3.

25. The method of claim 21, wherein the effective amount of detergent additive is about 10 PTB to 300 PTB.

* * * * *